US006550900B2

(12) United States Patent
Chan et al.

(10) Patent No.: US 6,550,900 B2
(45) Date of Patent: Apr. 22, 2003

(54) INK CONTAINER WITH AN ELASTIC DEFORMATION DEVICE

(75) Inventors: Hsun-Hsien Chan, Chu-Pei (TW); Chih-Ching Chen, Taipei (TW)

(73) Assignee: BenO Corporation, Kweishan (TW)

( * ) Notice: Subject to any disclaimer, the term of this patent is extended or adjusted under 35 U.S.C. 154(b) by 0 days.

(21) Appl. No.: 09/683,652

(22) Filed: Jan. 29, 2002

(65) Prior Publication Data

US 2002/0130933 A1 Sep. 19, 2002

(30) Foreign Application Priority Data

Mar. 16, 2001 (TW) ..... 90106276 A

(51) Int. Cl.[7] ..... B41J 2/175
(52) U.S. Cl. ..... 347/86
(58) Field of Search ..... 347/85, 86, 87; 222/105, 386.5

(56) References Cited

U.S. PATENT DOCUMENTS 5,270,739 A * 12/1993 Kitani et al. ..... 347/87
5,719,609 A * 2/1998 Huack et al. ..... 347/85
5,764,259 A * 6/1998 Nakajima et al. ..... 347/86
5,801,737 A * 9/1998 Sato et al. ..... 347/86
5,877,794 A * 3/1999 Takagi ..... 347/87
6,019,459 A * 2/2000 Pew et al. ..... 347/85
2002/0057318 A1 * 5/2002 Shyn et al. ..... 347/86
2002/0067398 A1 * 6/2002 Shyn et al. ..... 347/86
2002/0071013 A1 * 6/2002 Hsu et al. ..... 347/86
2002/0122083 A1 * 9/2002 Hsu et al. ..... 347/7

FOREIGN PATENT DOCUMENTS

JP 62-5994 * 1/1987
TW 373595 11/1999

* cited by examiner

*Primary Examiner*—Michael Nghiem
(74) *Attorney, Agent, or Firm*—Winston Hsu

(57) ABSTRACT

An ink container having an ink reservoir for storing ink, a cover set above the ink reservoir for forming an ink adjusting room with a top portion of the ink reservoir, an ink outlet for providing ink within the ink reservoir, and an elastic deformation device set within the ink reservoir. The elastic deformation device is connected to the gap of the ink reservoir to accept external air into the elastic deformation device. When a pressure within the ink reservoir is lower than a pressure of external air, the external air flowing into the elastic deformation device of the ink container causes the elastic deformation device to expand. When the pressure within the ink reservoir is higher than the pressure of the external air, the elastic deformation device shrinks to have an outwardly overlapping wall with a folding shape in order to balance the pressure of the external air with the pressure of the ink reservoir.

20 Claims, 8 Drawing Sheets

INK CONTAINER WITH AN ELASTIC DEFORMATION DEVICE

BACKGROUND OF INVENTION

1. Field of the Invention

The present invention relates to an ink container and more specifically to an ink container with an elastic deformation device.

2. Description of the Prior Art

Please refer to FIG. 1. FIG. 1 is a diagram of a prior art ink container 10 with an ink adjusting room 15. FIG. 1 is disclosed in U.S. Pat. No. 5,764,259. An ink container 10 comprises an ink reservoir 12 for storing ink, a negative regulating chamber 5 being connected to external air, and a buffer chamber 15 being connected to the external air and the ink reservoir 12. The negative regulating chamber 5 absorbs the external air through an air vent 8. A slab 18 set above the negative regulating chamber 5 is used to change a volume of the negative regulating chamber 5 by a weight of the slab 18, so that pressure within the ink reservoir 12 is adjusted. Furthermore, when the negative regulating chamber 5 expands to a maximum such that the negative regulating chamber 5 can not be used to change volume to adjust the pressure within the ink reservoir 12, the external air flows into the ink reservoir 12 through an air vent 16 and a connecting vent 25 to decrease the pressure within the ink reservoir 12.

When ink within the ink reservoir 12 stops flowing out of the ink container 10 through an ink outlet 21, pressure outside the ink container 10 decreases, the negative regulating chamber 5 is pressed, and ink within the ink reservoir 12 is allowed to flow into the buffer chamber 15 through the connecting vent 25, so that the ink within the ink reservoir 12 can not unexpectedly flow out of the ink outlet 21 because of the low external air.

Nevertheless, the buffer chamber 15 and the connecting vent 25 are set below a water line. If the connecting vent 25 is too big in a manufacturing process, ink of the ink reservoir 12 is allowed to flow into the buffer chamber 15, when filled with water, then flow out of the ink container 10 through the air vent 16.

SUMMARY OF INVENTION

It is therefore a primary objective of the present invention to provide an ink container with an elastic deformation device set above an ink reservoir for avoiding ink within the ink reservoir flowing out of the ink container.

The present invention discloses an ink container with an elastic deformation device. The ink container includes an ink reservoir for storing ink, a cover set above the ink reservoir for forming an ink adjusting room with a top portion of the ink reservoir, an ink outlet for providing ink within the ink reservoir, and an elastic deformation device set within the ink reservoir. The elastic deformation device is connected to the gap of the ink reservoir to accept external air into the elastic deformation device. When the pressure within the ink reservoir is lower than a pressure of external air, the external air flowing into the elastic deformation device of the ink container causes the elastic deformation device to expand. When the pressure within the ink reservoir is higher than the pressure of the external air, the elastic deformation device shrinks to have an outwardly overlapping wall with a folding shape in order to balance the pressure of the external air with the pressure of the ink reservoir.

It is an advantage of the present invention that the ink container utilizes the elastic deformation device with a self-elasticity to adjust the pressure within the ink container. Furthermore, the ink adjusting room of the ink container is set on a top portion of the ink reservoir, so that when ink flows into the ink adjusting room, an air vent does not allow the ink to flow out of the ink container.

These and other objectives and advantages of the present invention will no doubt become obvious to those of ordinary skill in the art after reading the following detailed description of the preferred embodiment that is illustrated in the various figures and drawings.

DETAILED DESCRIPTION

Figure 1:
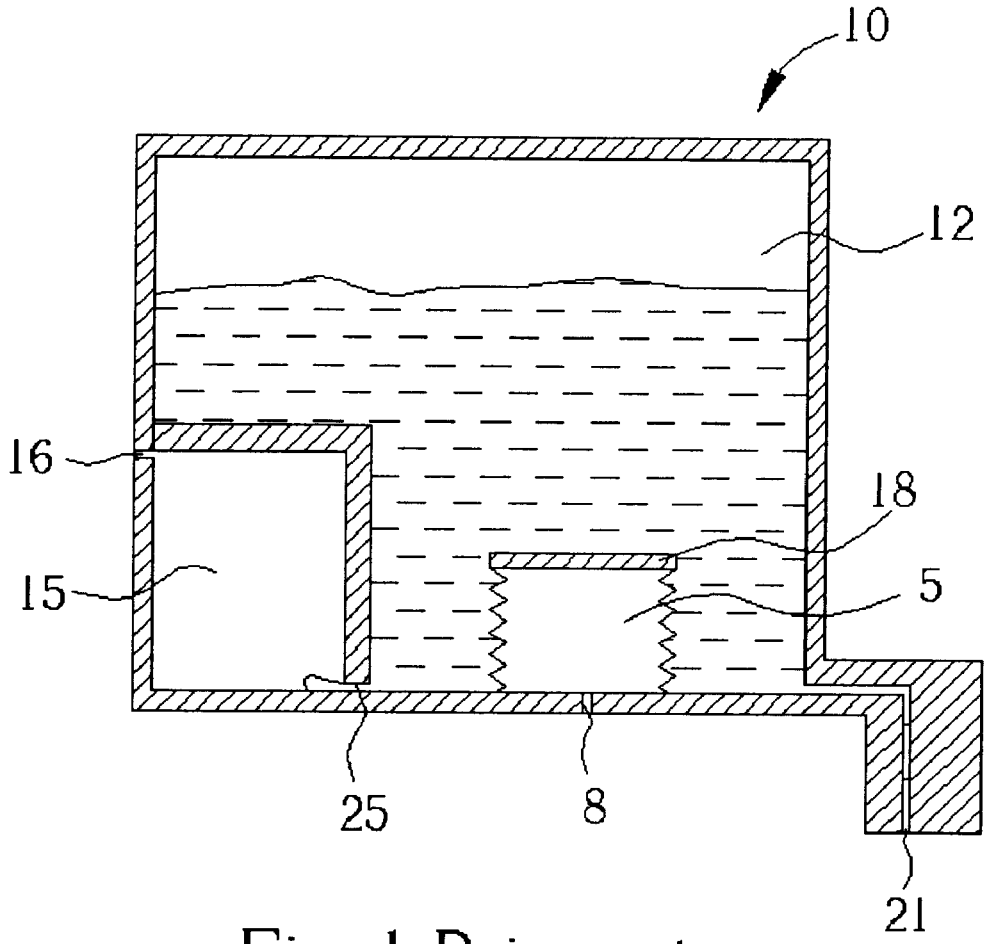
Fig. 1 Prior art
FIG. 1 is a diagram of a prior art ink container with an ink adjusting room.
Figure 2:
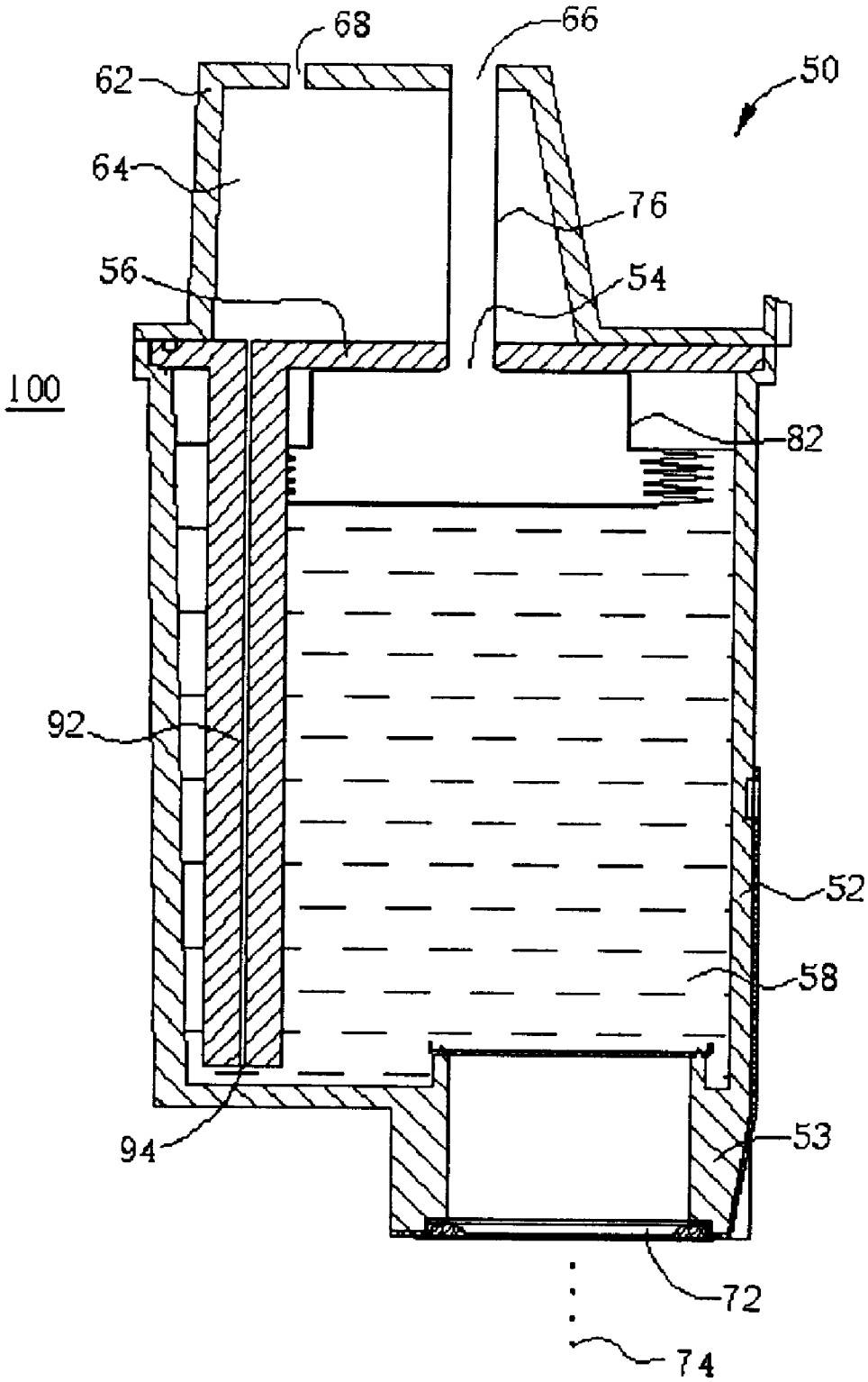
FIG. 2 is a diagram of a first preferred embodiment ink container according to the present invention.

Please refer to FIG. 2. FIG. 2 is a diagram of a present first preferred embodiment ink container 50. The ink container 50 comprises an ink reservoir 52 for storing ink, a cover 62 set above the ink reservoir 52 for forming the ink adjusting room 64 with the top portion 56 of the ink reservoir 52, an ink outlet 72 set in a bottom portion 53 of the ink reservoir 52 for providing ink 58 to the outside of the ink reservoir 52 to form ink drops 74, an elastic deformation device 82 for adjusting pressure within the ink reservoir 52, and an air supplying device 92 connected to the top portion 56 of the ink reservoir 52 for transmitting air of ink 58. For this example, the air-supplying device 92 is a pipe 92. The ink reservoir 52 further comprises a gap 54 on the top portion 56. The cover 62 comprises a first air vent 66 and a second air vent 68. The elastic deformation device 82, set within the ink reservoir 52, is connected to the gap 54 of the ink reservoir 52. Additionally, the elastic deformation device 82 further comprises an air transmitting pipe 76 connected to the gap 54 of the ink reservoir 52 and the first air vent 66 of the cover 62 for transmitting external air into the elastic deformation device 82. When the external air flows into the elastic deformation device 82, the elastic deformation device 82 is deformed for adjusting pressure within the ink reservoir 52. Air 100 outside the ink container 50 can flow into the ink adjusting room 64 through the second air vent 68, being connected to the ink reservoir 52 by the pipe 92.

As FIG. 2 shows, an end 94 of the pipe 92 can form a gaseous state/liquid state interface with ink 58, and capillarity between the end 94 and the ink 58 forms a liquid seal. When the liquid seal is formed, air outside the ink container 50 can not flow into the ink reservoir 52 through the pipe 92, and neither can the ink 58 of the ink reservoir 52 flow into the pipe 92.

The elastic deformation device 82 produces a self-shrinking force by self-elasticity. A volume of the elastic deformation device 82 is reduced to a predetermined range owing to the self-shrinking force. When the elastic deformation device 82 is disposed within the ink reservoir 52, the inward force performs an action on the elastic deformation device 82 such that pressure within the ink reservoir 52 is lower than pressure of external air 100. When a pressure difference between the ink reservoir 52 and the external air 100 exceeds a certain value, the ink 58 within the ink reservoir 52 can not flow out of the ink outlet 72. So, the elastic deformation device 82 has a function of adjusting pressure within the ink reservoir 52 in order to avoid the ink flowing out of the ink outlet 72.

Figure 3:
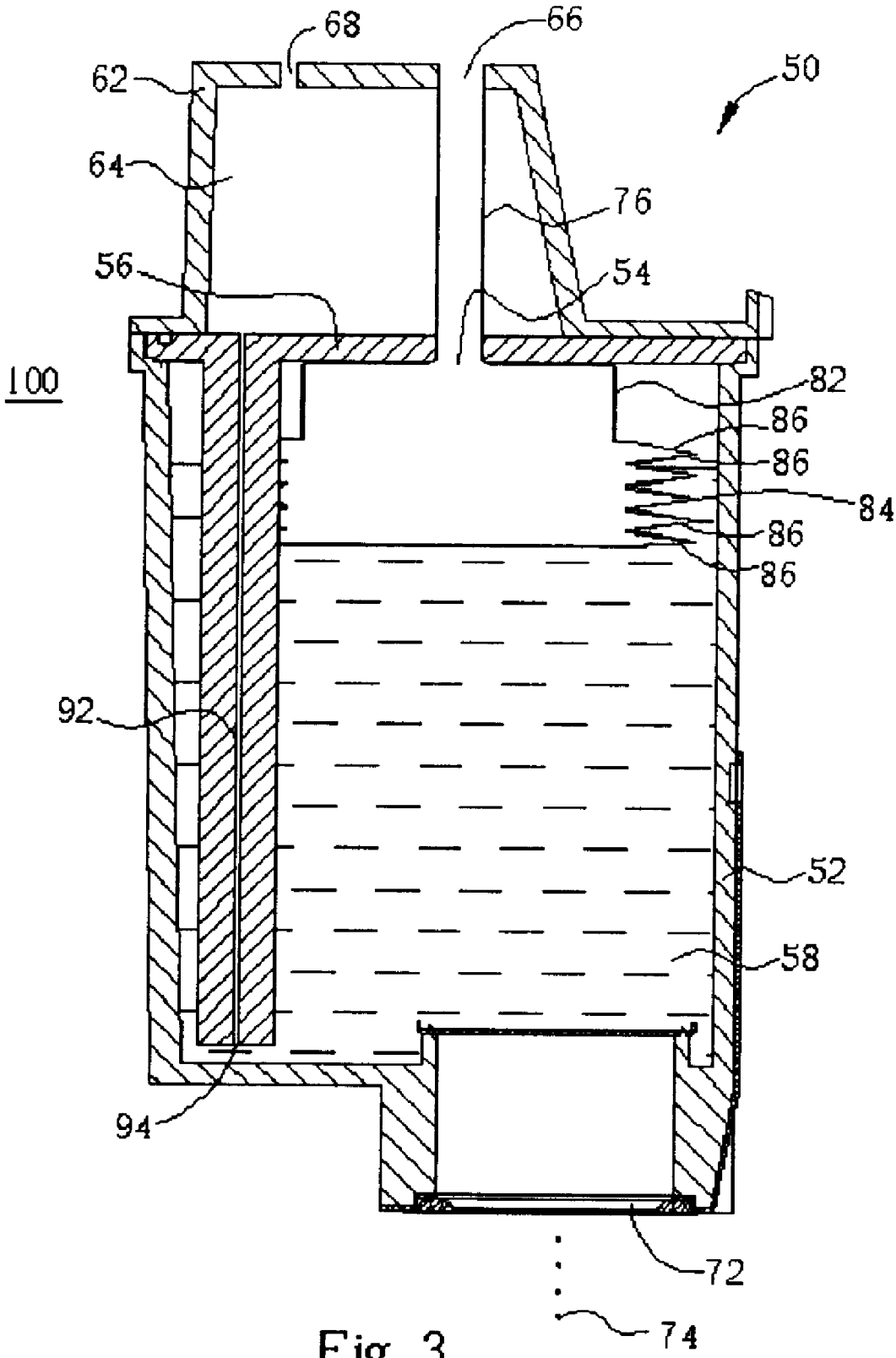
FIG. 3 is a diagram of an elastic deformation device when expanding as shown in FIG. 2.
Figure 4:
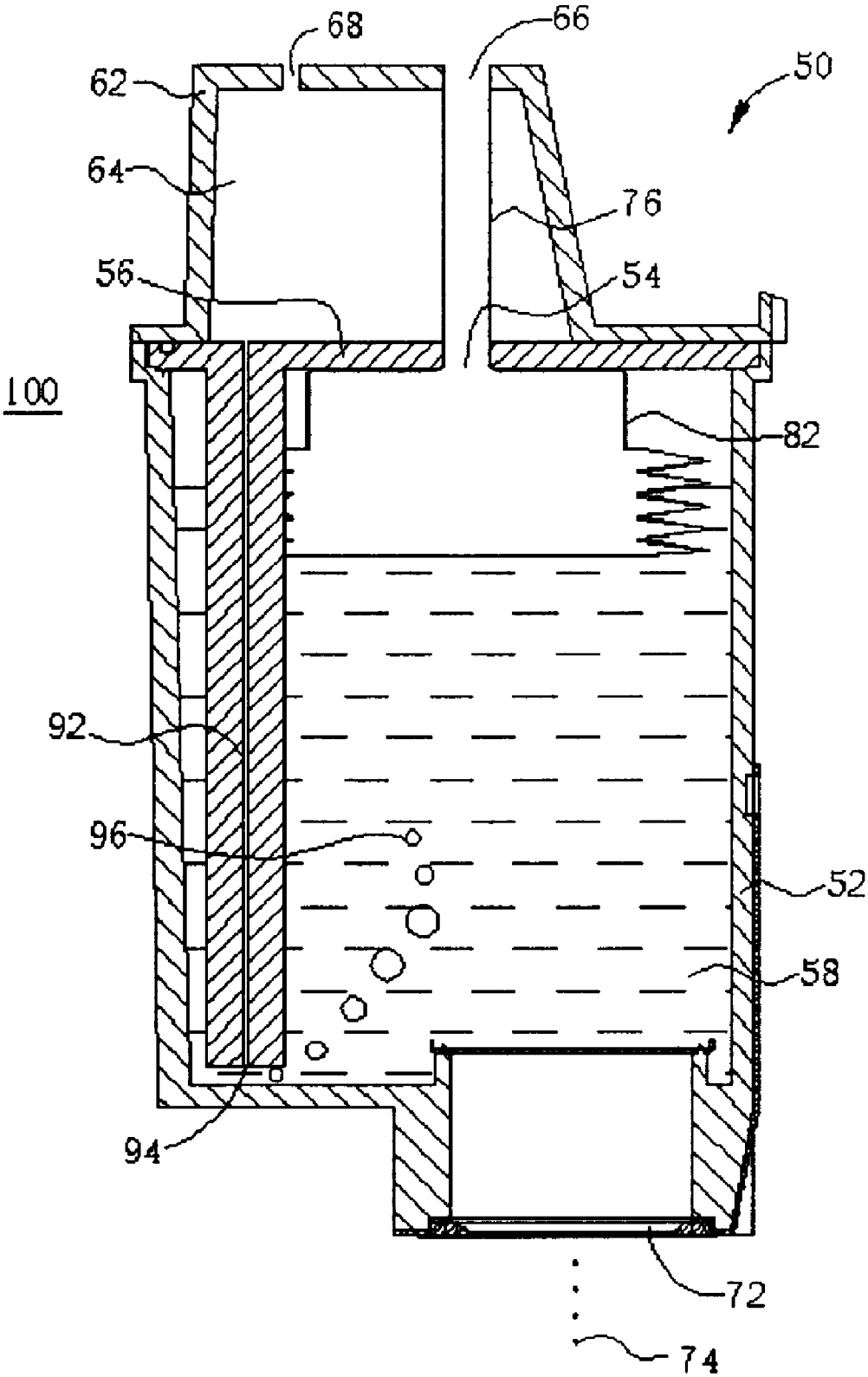
FIG. 4 is a diagram of air entering into an ink reservoir as shown in FIG. 2.
Figure 5:
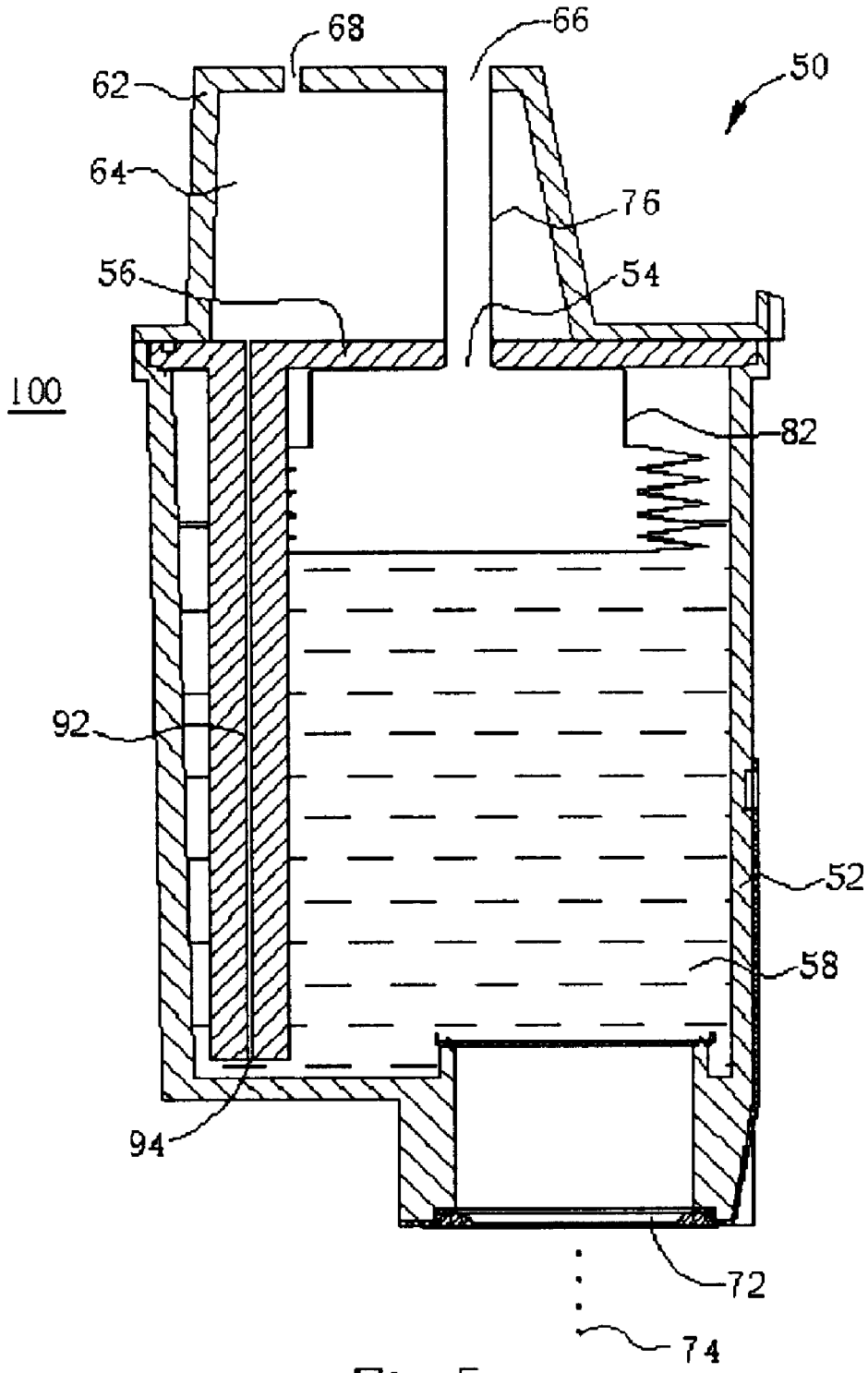
FIG. 5 is a diagram of air stopping entering into an ink reservoir as shown in FIG. 2.
Figure 6:
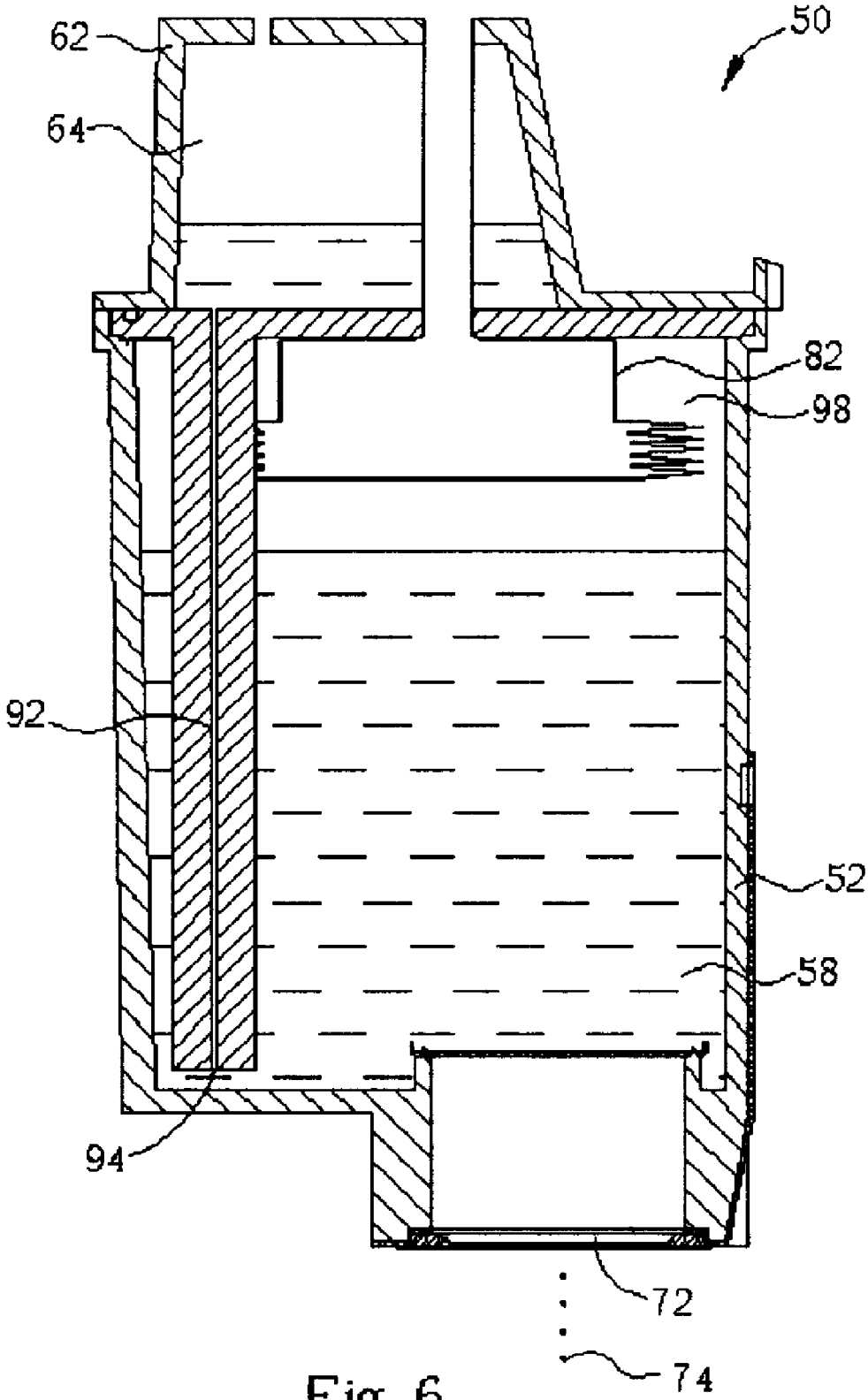
FIG. 6 is a diagram of ink flowing into an ink adjusting room as shown in FIG. 2.

Please refer to FIG. 2 to FIG. 6. FIG. 3 is a diagram of an elastic deformation device 82 when expanding, as shown in FIG. 2. FIG. 4 is a diagram of external air 100 entering into an ink reservoir 52 in a form of bubbles 96, as shown in FIG. 2. FIG. 5 is a diagram of air stopping entering into an ink reservoir 52, as shown in FIG. 2. FIG. 6 is a diagram of ink 58 flowing into an ink adjusting room 64, as shown in FIG. 2. As FIG. 3 shows, when ink 58 of the ink reservoir 52 flows out of the ink outlet 72 to form ink drops 74, pressure within the ink reservoir 52 is lower than external air 100. External air outside the ink container 50 flows into the elastic deformation device 82 through the transmitting pipe 76, so that the elastic deformation device 82 expands. When the elastic deformation device 82 expands, the pressure within the ink reservoir 52 increases.

As FIG. 4 shows, when the elastic deformation device 82 expands to a certain range, the elastic deformation device 82 can not adjust the pressure within the ink reservoir 52 by changing the volume of the elastic deformation device 82. External air 100 flows into the ink reservoir 52 to produce the bubbles 96 through the second air vent 68, the ink adjusting room 64 and the pipe 92, such that the pressure within the ink reservoir 52 increases.

As FIG. 5 shows, when the ink container stops outputting the ink 58, the external air 100 stops flowing into the ink reservoir 52. As FIG. 6 shows, when a compressing maximum of the elastic deformation device 82 is exceeded, the pressure outside the ink container 50 decreases, such that the pressure within the ink reservoir 52 increases to move the ink 58 within the ink reservoir 52. Fluid resistance of the ink outlet 72 is higher than the pipe 92, causing the ink 58 to flow into the ink adjusting room 64. When the pressure outside the ink container 50 decreases, the ink 58 within the ink reservoir 52 can not flow out of the ink container 50 because the pressure within the ink reservoir 52 increases.

As FIG. 3 shows, the elastic deformation device 82 comprises a folding surface 84 having a plurality of inclined planes 86, wherein when the elastic deformation device 82 shrinks to have an outwardly overlapping wall with a folding shape, by a self-shrinking force. In other words, when a volume of the elastic deformation device 82 is decreased, the plurality of inclined planes 86 are mutually near, and when the volume of the elastic deformation device 82 is increased, the plurality of inclined planes 86 are mutually far away. The elastic deformation device 82 therefore has a large range to change the volume in order to adjust the pressure within the ink reservoir 52.

Figure 7:
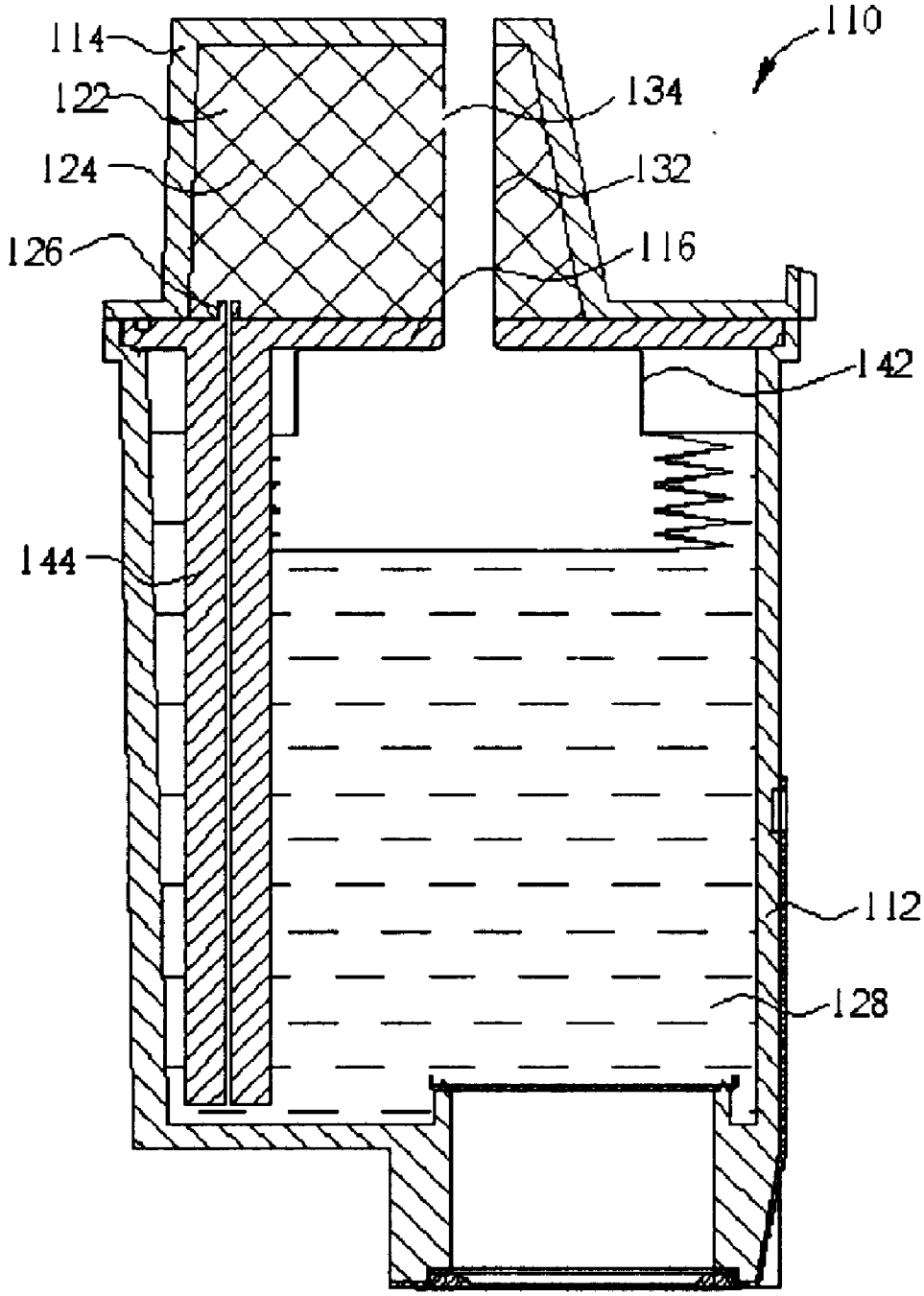
FIG. 7 is a diagram of a second preferred embodiment ink container according to the present invention.

Please refer to FIG. 7. FIG. 7 is a diagram of a second preferred embodiment ink container 110 according to the present invention. The ink container 110 comprises an ink reservoir 112 for storing ink 128, a cover 114 set above the ink reservoir 112 for forming an ink adjusting room 122 with a top portion 116 of the ink reservoir 112, and an elastic deformation device 142 for adjusting pressure within the ink reservoir 112. The elastic deformation device 142 comprises an air transmitting pipe 132 for transmitting external air into the elastic deformation device 142. The air transmitting pipe 132 comprises a second air vent 134 for transmitting the external air into the ink adjusting room 122. The ink adjusting room 122 further comprises an ink absorber 124 (such as a sponge), filled within the ink adjusting room 122. When the ink 128 within the ink reservoir 112 flows into the ink adjusting room 122, the ink absorber 124 can absorb the ink 128 so as to avoid the ink 128 flowing into the elastic deformation device 142 through the second air vent 134.

Furthermore, a protuberance 126 is set above the top portion 116 of the ink reservoir 112 for withstanding a bottom portion 124 of the ink reservoir 112. The ink 128 within the ink adjusting room 122 flows back into the ink reservoir 112 through a pipe 144, and the protuberance 126 provides capillarity for the ink absorber 124, such that the ink 128 absorbed by the ink absorber 124 can flow back into the ink reservoir 112.

Figure 8:
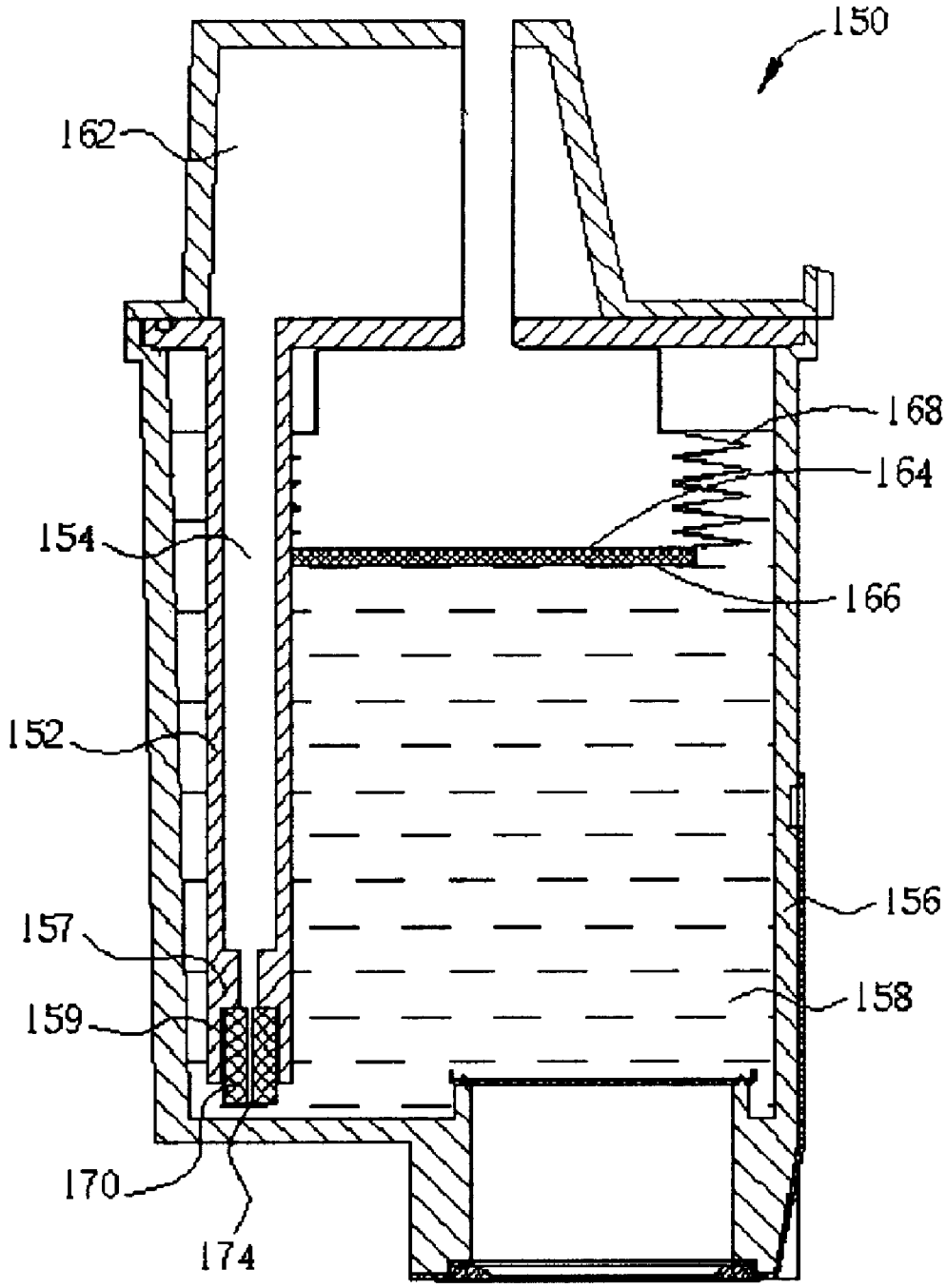
FIG. 8 is a diagram of a third preferred embodiment ink container according to the present invention.

Please refer to FIG. 8. FIG. 8 is a diagram of a third preferred embodiment ink container 150 according to the present invention. A hollow pipe 152 of the ink container 150 comprises an ink storage passage 154, and an elastic deformation device 168 comprises a flat bottom 164 with a slab 166 set below the flat bottom 164. The hollow pipe 152 comprises a fillister 159 adjacent to the bottom portion 157 of an ink reservoir 156 for communicating with a ventilated component 170. The ventilated component 170 comprises an opening 174 for connecting the bottom portion 157 of the ink reservoir 156 with an ink adjusting room 162. When pressure of external air is dropped, the ink 158 within the ink reservoir 156 can fill the ink storage passage 154, then flow into the ink adjusting room 162. Additionally, when a volume of the elastic deformation device 168 has changed, the elastic deformation device 168 can produce regular deformation under restrictions on gravity of the slab 166.

In contrast to the prior art, the present ink container utilizes the elastic deformation device with a self-elasticity to adjust the pressure within the ink container. Furthermore, the ink adjusting room of the ink container is set on a top portion of the ink reservoir, so that when ink flows into the ink adjusting room, an air vent does not allow the ink to flow out of the ink container.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ink container comprising:

an ink reservoir for storing ink, the ink reservoir having a gap on a top portion;

an ink outlet set in a bottom portion of the ink reservoir for providing ink to the outside of within the ink reservoir;

an elastic deformation device set within the ink reservoir, the elastic deformation device being connected to the gap of the ink reservoir to accept external air into the elastic deformation device, the elastic deformation device being capable of adjusting pressure within the ink reservoir by producing deformation according to a magnitude of a pressure within the ink reservoir or elasticity of the elastic deformation device; and an ink adjusting room set on a top portion of the ink reservoir;

wherein when the pressure within the ink reservoir is lower than a pressure of external air, the external air flowing into the elastic deformation device of the ink container causes the elastic deformation device to expand, and when the pressure within the ink reservoir is higher than the pressure of the external air, ink within the ink reservoir is capable of flowing into the ink adjusting room, and the elastic deformation device shrinks to have an outwardly overlapping wall with a folding shape in order to balance the pressure of the external air with the pressure of the ink reservoir.

2. The ink container of claim 1 wherein the elastic deformation device has a self-shrinking force.

3. The ink container of claim 1 further comprising a cover set above the ink reservoir for forming the ink adjusting room with the top portion of the ink reservoir.

4. The ink container of claim 1 wherein the ink adjusting room comprises an air vent, the air vent allowing external air to flow into the ink adjusting room, the ink adjusting room being connected with the ink reservoir.

5. The ink container of claim 1 wherein the ink adjusting room further comprises an ink absorber, such that when the ink within the ink reservoir flows into the ink adjusting room, the ink absorber absorbs the ink flowing into the ink adjusting room.

6. The ink container of claim 5 wherein the ink adjusting room further comprises a protuberance for withstanding a bottom portion of the ink absorber.

7. The ink container of claim 1 further comprising an air supplying device, wherein when the elastic deformation device expands to a determined extent, air within the ink adjusting room flows into the ink reservoir through the air supplying device.

8. The ink container of claim 7 wherein when the pressure within the ink reservoir is higher than the pressure of the external air, the ink within the ink reservoir flows into the ink adjusting room through the air supplying device, and when the pressure within the ink reservoir is lower than the pressure of the external air, the ink within the ink adjusting room flows into the ink reservoir through the air supplying device.

9. The ink container of claim 8 wherein the air supplying device comprises an ink storage passage, wherein when the pressure within the ink reservoir is higher than the pressure of the external air, the ink within the ink reservoir pours fully into the ink storage passage and then flows into the ink adjusting room.

10. The ink container of claim 7 wherein the air supplying device is a pipe, the pipe having an opening for connecting the bottom portion of the ink reservoir with the ink adjusting room.

11. The ink container of claim 7 wherein the air supplying device is a hollow pipe, the hollow pipe comprising a fillister adjacent to the bottom portion of the ink reservoir for accommodating a ventilated component, the ventilated component having an opening for connecting the bottom portion of the ink reservoir with the ink adjusting room.

12. The ink container of claim 1 wherein the elastic deformation device comprises a folding surface having a plurality of inclined planes, wherein when a volume of the elastic deformation device is decreased, the plurality of inclined planes are mutually near, and when the volume of the elastic deformation device is increased, the plurality of inclined planes are mutually far away.

13. The ink container of claim 1 wherein the elastic deformation device has a flat bottom with a slab set below the flat bottom, wherein when the volume of the elastic deformation device has been changed, the slab enables the elastic deformation device to produce regular deformation.

14. An ink container comprising:

an ink reservoir for storing ink, the ink reservoir having a gap on a top portion;

an ink outlet set in a bottom portion of the ink reservoir for providing ink to the outside of the ink reservoir; and an ink adjusting room set on a top portion of the ink reservoir and being connected with the ink reservoir, the ink adjusting room being connected to the gap of the ink reservoir to accept external air into the ink adjusting room, the ink adjusting room comprising an ink absorber, and a protuberance for contacting a bottom portion of the ink absorber, such that when the ink within the ink reservoir flows into the ink adjusting room, the ink absorber absorbs the ink flowing into the ink adjusting room, wherein when the pressure within the ink reservoir is lower than a pressure of external air, the external air flows into the ink adjusting room of the ink container, and when the pressure within the ink reservoir is higher than the pressure of the external air, ink within the ink reservoir is capable of flowing into the ink adjusting room in order to balance the pressure of the external air with the pressure of the ink reservoir.

15. An ink container comprising:

an ink reservoir for storing ink, the ink reservoir having a gap on a top portion;

an ink outlet set in a bottom portion of the ink reservoir for providing ink to the outside of the ink reservoir;

an ink adjusting room set on a top portion of the ink reservoir and being connected with the ink reservoir, the ink adjusting room being connected to the gap of the ink reservoir to accept external air into the ink adjusting room;

an elastic deformation device set within the ink reservoir, the elastic deformation device being connected to the gap of the ink reservoir to accept external air into the elastic deformation device, the elastic deformation device being capable of adjusting pressure within the ink reservoir by producing deformation according to a magnitude of a pressure within the ink reservoir or elasticity of the elastic deformation device; and an air supplying device, wherein when the elastic deformation device expands to a determined extent, air within the ink adjusting room flows into the ink reservoir through the air supplying device, wherein when the pressure within the ink reservoir is lower than a pressure of external air, the external air flows into the ink adjusting room of the ink container, and when the pressure within the ink reservoir is higher than the pressure of the external air, ink within the ink reservoir is capable of flowing into the ink adjusting room in order to balance the pressure of the external air with the pressure of the ink reservoir.

16. The ink container of claim 15 wherein when the pressure within the ink reservoir is higher than the pressure of the external air, the ink within the ink reservoir flows into the ink adjusting room through the air supplying device, and when the pressure within the ink reservoir is lower than the pressure of the external air, the ink within the ink adjusting room flows into the ink reservoir through the air supplying device.

17. The ink container of claim 16 wherein the air supplying device comprises an ink storage passage, wherein when the pressure within the ink reservoir is higher than the pressure of the external air, the ink within the ink reservoir pours fully into the ink storage passage and then flows into the ink adjusting room.

18. The ink container of claim 15 wherein the air supplying device is a pipe, the pipe having an opening for connecting the bottom portion of the ink reservoir with the ink adjusting room.

19. The ink container of claim 15 wherein the air supplying device is a hollow pipe, the hollow pipe comprising a fillister adjacent to the bottom portion of the ink reservoir for accommodating a ventilated component, the ventilated component having an opening for connecting the bottom portion of the ink reservoir with the ink adjusting room.

20. An ink container comprising:

an ink reservoir for storing ink, the ink reservoir having a gap on a top portion;

an ink outlet set in a bottom portion of the ink reservoir for providing ink within the ink reservoir;

an elastic deformation device set within the ink reservoir, the elastic deformation device being connected to the gap of the ink reservoir to accept external air into the elastic deformation device, the elastic deformation device being capable of adjusting pressure within the ink reservoir by producing deformation according to a magnitude of a pressure within the ink reservoir or elasticity of the elastic deformation device;

wherein when the pressure within the ink reservoir is lower than a pressure of external air, the external air flowing into the elastic deformation device of the ink container causes the elastic deformation device to expand, and when the pressure within the ink reservoir is higher than the pressure of the external air, the elastic deformation device shrinks to have an outwardly overlapping wall with a folding shape in order to balance the pressure of the external air with the pressure of the ink reservoir, wherein the elastic deformation device has a flat bottom with a slab set below the flat bottom, and when the volume of the elastic deformation device has been changed, the slab enables the elastic deformation device to produce regular deformation.

* * * * *